US006467239B2

(12) United States Patent
Mossbeck et al.

(10) Patent No.: US 6,467,239 B2
(45) Date of Patent: Oct. 22, 2002

(54) METHOD OF PACKAGING SPRING UNITS

(75) Inventors: Niels S. Mossbeck; Thomas J. Wells, both of Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 10/034,823

(22) Filed: Dec. 27, 2001

(65) Prior Publication Data

US 2002/0053188 A1 May 9, 2002

Related U.S. Application Data

(63) Continuation-in-part of application No. 09/712,503, filed on Nov. 14, 2000, which is a continuation-in-part of application No. 09/397,337, filed on Sep. 15, 1999, now abandoned.

(51) Int. Cl.[7] ..... B65B 63/04

(52) U.S. Cl. ..... 53/430; 53/114; 53/118; 29/91.1

(58) Field of Search ..... 53/430, 383.1, 53/376.5, 118, 114; 5/654.1, 739, 655.7, 721; 29/91.1, 91.5, 91.6

(56) References Cited

U.S. PATENT DOCUMENTS

| | | | | |
|---|---|---|---|---|
| 1,643,091 A | | 9/1927 | Rosenthal et al. | |
| 1,685,851 A | | 10/1928 | MacInerney | |
| 1,898,573 A | | 2/1933 | Schubert | |
| 2,114,008 A | * | 4/1938 | Wunderlich | 100/138 |
| 2,129,038 A | | 9/1938 | Schob | |
| 2,193,410 A | | 3/1940 | Schubert | |
| 2,247,543 A | | 7/1941 | Bernstein | |
| 3,111,690 A | * | 11/1963 | Tarlow | 297/452.49 |
| 3,200,418 A | | 8/1965 | Lebens | |
| 3,325,833 A | | 6/1967 | Withoff | |
| 3,576,040 A | | 4/1971 | Larsen | |
| 3,579,774 A | * | 5/1971 | Shreve | 29/91 |
| 4,995,162 A | * | 2/1991 | Betere Cabeza | 29/564.2 |
| 5,438,718 A | * | 8/1995 | Kelly et al. | 29/91.1 |
| 5,761,784 A | * | 6/1998 | Ogle et al. | 5/420 |

* cited by examiner

*Primary Examiner*—Rinaldi I. Rada
*Assistant Examiner*—Christopher Harmon
(74) *Attorney, Agent, or Firm*—Wood, Herron & Evans L.L.P.

(57) ABSTRACT

A method of packaging spring units in which first and second webs of insulator material are fixedly located against the top and bottom surfaces of the spring units. The webs are folded around outermost coil springs along longitudinal edges of the spring units. The reverse sides of the webs are glued, welded or otherwise permanently secured together. In another embodiment, side portions of the webs are secured together, sandwiching the spring units therebetween. The resultant bedding products are then roll-packed.

24 Claims, 7 Drawing Sheets

METHOD OF PACKAGING SPRING UNITS

CROSS-REFERENCE TO RELATED APPLICATIONS

This patent application is a continuation-in-part application of U.S. patent application Ser. No. 09/712,503, filed Nov. 14, 2000, entitled METHOD OF PACKAGING SPRING UNITS, which is in turn a continuation-in-part application of U.S. patent application Ser. No. 09/397,337, filed Sep. 15, 1999, now abandoned, entitled "METHOD OF PACKAGING SPRINGS AND RESULTING PACKAGED PRODUCT", both of which are fully incorporated by reference herein.

FIELD OF THE INVENTION

This invention relates to the packaging of springs. More specifically, this invention relates to a method of roll-packing plural spring units.

BACKGROUND OF THE INVENTION

At the present time, most mattress spring core assemblies are manufactured by a spring company and then compressed and shipped in a crate to a mattress manufacturer, who then uncrates the spring cores, applies a primary insulator to the top and bottom surfaces of the mattress, and then applies conventional padding and upholstery to complete the mattress. In order to keep the mattress springs straight and avoid the mattresses top and bottom surfaces being permanently canted and distorted as the springs are compressed for shipment in a crate, there are rods inserted through the springs during the compression process. These rods function to prevent misalignment of the top and bottom surfaces of the springs during compression, which rods are then removed after compression and during shipment within the crate.

As an alternative to compression of the springs for shipment in crates, some spring assemblies are compressed and roll-packed while sandwiched only between separator plies of paper or plastic, which paper or plastic may be either discarded or reused, depending on the nature of the separating materials.

For instance, it is known in the art to pack spring units for use in making mattresses by winding disposable paper or re-usable hessian around a mandrel and feeding the spring units successively into the nip between the growing roll and the traveling web material. The spring units are compressed as they are drawn into the roll, and the result is that the roll-packed springs have a much reduced volume as compared to conventionally stacked spring units.

One type of machine known for this purpose has a winding mandrel to which a holding bar is bolted by its ends for holding the leading end of a packing web material. An upwardly moveable pressure roller is mounted above the mandrel so as to define therewith an entry nip for the web material. The web material is fed from a reel supported at the rear of the machine over the pressure roller and on to the mandrel. An operator standing at the front of the machine feeds springs into the entry nip.

Another machine for packing bedding springs is seen in U.S. Pat. No. 4,669,247. The '247 patent describes packing spring units into a roll with a web of disposable paper or reusable material. A similar spring packing machine is seen in U.S. Pat. No. 2,114,008, in which a roll of disposable wrapping paper is fed along a table and into a wrapping mechanism whereat spring assemblies are placed upon the paper and fed into the machine by the paper movement.

All of these prior art machines compress and wrap springs in a single web of disposable paper or reusable material which separates the multiple layers of spring units in a roll and maintains the springs in a compressed state for shipment from a spring manufacturer to a mattress manufacturer. The mattress manufacturer then must apply and attach an insulated pad to at least the top and usually the top and bottom of the spring unit before adding conventional padding and upholstery to the unit to complete the mattress.

It has been one objective of the present invention to facilitate and ease the manufacture of spring mattresses by the mattress manufacturer.

It has been a further objective of the present invention to provide a method of roll packaging spring units in which the spring units are packaged in part with insulator material that becomes part of the mattress and is used by the mattress manufacturer in mattress production.

It has been yet another objective of the present invention to provide a series of roll packed spring units in which the insulator material is permanently applied to the spring units either as a part of or before the roll packing of the spring units.

SUMMARY OF THE INVENTION

The preferred embodiments of the present invention accomplish these objectives with a method of packaging a plurality of resilient spring units each comprising a plurality of interconnected coil springs. First and second webs of spring insulator material are attached to the spring units so as to be located against top and bottom surfaces of the spring units. The spring units with the webs of insulator material permanently attached thereto are thereafter roll-packed for shipment from a spring manufacturer to a mattress manufacturer who simply unrolls the spring units and, if the insulator material had not been previously cut between spring units prior to roll packing, cuts the insulator material between the spring units and proceeds to complete the mattress by adding conventional padding and upholstery.

Each spring unit has a uniform depth defined by a generally planar top or first surface and a parallel generally planar bottom or second surface. The spring unit has a longitudinal dimension or length defined by a pair of opposed parallel end surfaces and a transverse dimension or width defined by a pair of opposed parallel side surfaces. The longitudinal dimension or length is generally greater than the transverse dimension or width of the spring unit as in most bedding products. However, a square spring unit in which the longitudinal and transverse dimensions are equal may also be packaged using this inventive method.

The method of the present invention includes providing a first and usually first and second web rolls of insulator material spaced from one another. The first web roll includes a first web of spring insulator material, e.g., woven or non-woven material, wound about a core. Similarly, the second web roll includes a second web of spring insulator material wound about a core. Each of the first and second webs of insulator material have a pair of opposed side edges defining a width of the web which is wider than the transverse dimensions of the spring units. Each web across its width has a pair of opposed side portions and a central portion between the side portions.

The first web of insulator material is passed over and located against the first surface of the spring unit, and the second web is passed under and located against the second surface of the spring unit. The longitudinal dimension of the spring unit is generally parallel to the opposed side edges of the first and second webs which are generally parallel to one another.

In a first preferred embodiment, the first and second webs are folded back upon themselves around the top and bottom turns of the edgemost coil springs of the spring unit so that the opposed side portions are located against the surface of the central portion located against the spring unit. These side portions are then bonded, welded or otherwise secured to the central portion.

In a second preferred embodiment, the side portions of the first web are bonded or welded to the adjacent side portions of the second web so as to form a tight fitting sleeve in which the spring unit is securely located. The spring unit with the first and second webs secured there against constitutes a bedding product.

The bedding product having the insulator material permanently attached thereto is inserted into a roll packing machine in which the bedding product is compressed and rolled onto a dowel or mandrel whereafter the bedding product is maintained in this rolled and compressed state for shipment to a mattress manufacturer.

In one embodiment of the present invention, after the insulator material is applied to the first and second surfaces of the spring unit, additional separator packing material such as paper or sheet plastic is used to separate layers of rolled bedding product. In particular, first and second webs of separating material are located against respective first and second webs of insulator material. As the bedding products are roll-packed, the first and second webs of separating material further package the series of bedding products. Then, in both the first and second embodiments of the present invention method, the series of packaged bedding products formed by the spring manufacturer is thereafter shipped to the mattress manufacturer. The series of roll-packed bedding products is then unrolled by the mattress manufacturer and, if the webs of insulator material had not been severed prior to roll packing, are severed into separate bedding products with the insulator material still applied to each spring unit so that the mattress manufacturer may use the permanently attached insulator material in the manufacture of a mattress.

As an alternative to the use of two webs of separating material located against first and second webs of insulator material during the roll packing of the bedding product having the insulator material permanently applied to at least one surface thereof, only one web of separating material may be utilized. In this event or embodiment, the web of separating material is first attached to the dowel or mandrel by having at least one wrap of the separating material applied to the dowel or mandrel after which the bedding products are sequentially fed into the nip between the dowel or mandrel and the web of separating material. The separating material then functions to maintain the roll packed bedding products in a compressed state and separated one from the other as they are rolled up through multiple plies or layers onto the dowel or mandrel. After an appropriate number of bedding products have been roll packed onto the dowel or mandrel, the single web of separating material is then wound about the exterior of the roll of roll packed bedding products and taped or glued or otherwise secured to the exterior of the pack to complete the roll pack. This roll pack is then shipped to the mattress manufacturer where the roll pack is unrolled by the manufacturer and the web or webs of insulator material are severed between separate bedding products if the web or webs of insulator material had not been severed prior to insertion of the bedding products into the roll packing machine. That mattress manufacturer then uses the bedding products having the insulator material already permanently attached to the spring units to manufacture a mattress by simply applying conventional padding and upholstery to the bedding product.

These and other objectives and advantages of this invention will be readily apparent from the following description of the drawings.

DETAILED DESCRIPTION OF THE PREFERRED EMBODIMENT

Figure 1:
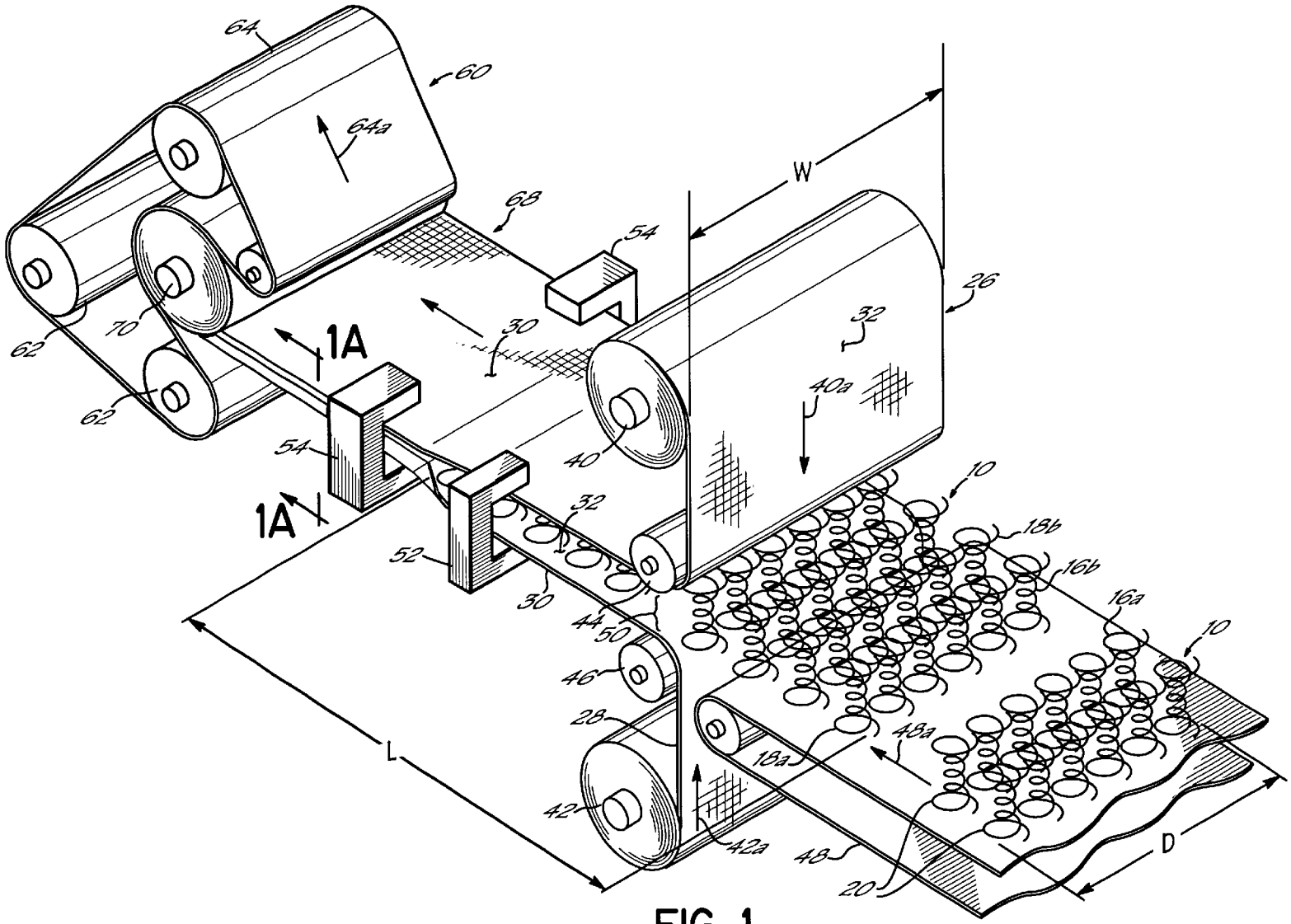
FIG. 1 is a perspective view of a first preferred embodiment of the present inventive method of packaging resilient spring units.
Figure 1A:
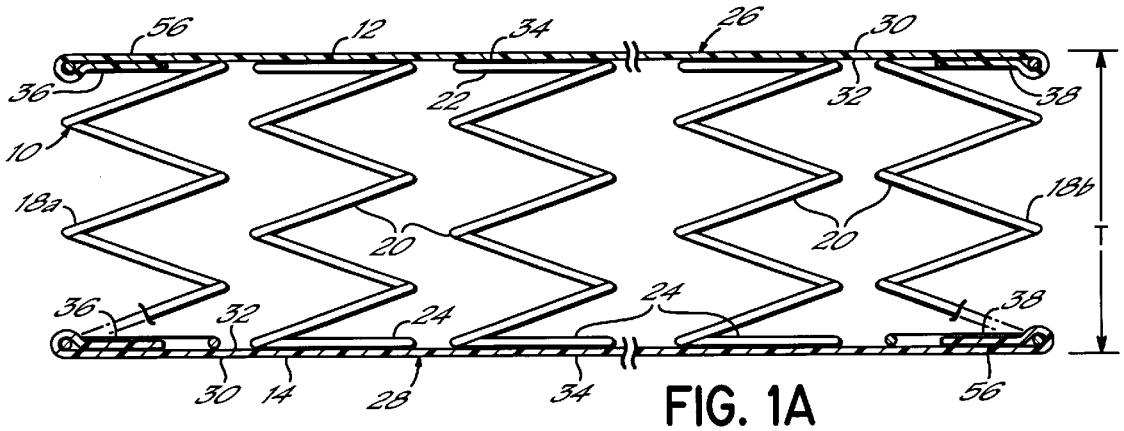
FIG. 1A is a cross-sectional view taken along line 1A—1A of FIG. 1.

As can be seen generally in FIGS. 1, 1A, 3, 3A, a spring unit 10 generally has a generally planar top or first surface 12 and a generally planar bottom or second surface 14. The spring unit 10 has a length or a longitudinal dimension L and a width or a transverse dimension D, the longitudinal dimension L being generally larger than the transverse dimension D. However, it will be appreciated by those in the art that L may be substantially similar to D in dimension. As seen in FIG. 1A, the spring unit 10 has a thickness T defined between the first surface 1 2 and the second surface 14. As illustrated in FIG. 1, the spring unit 10 also has opposing end surfaces 16*a*, 16*b* and opposing side surfaces 18*a*, 18*b*.

The spring unit 10 is generally comprised of a plurality of aligned coil springs 20 arranged in longitudinally extending columns and transversely extending rows. The coil springs 20 are secured one to another by means generally known in the art such as helical lacing wires. Each coil spring 20 has a top turn 22 comprising a portion of the first surface 12 and a bottom turn 24 comprising a portion of the second surface 14.

The first and second surfaces 12, 14 of the spring unit 10 are covered with first and second webs 26, 28, respectively, of insulator material. The insulator material used to cover the first and second surfaces 12, 14 of the spring unit 10 is generally a woven or non-woven material. Each of the first and second webs 26, 28 have an outer surface 30 and inner surface 32. The inner surface 32 of each of the first and second webs 26, 28 is located against the first and second surfaces 12, 14 of the spring unit 10, respectively.

Figure 3A:
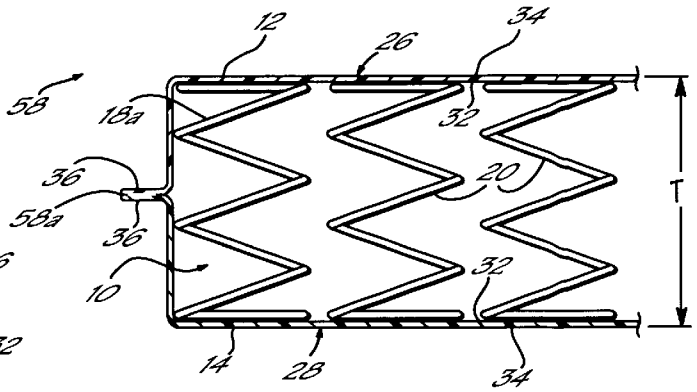
FIG. 3A is a cross-sectional view taken along line 3A—3A of FIG. 3.

As seen in FIGS. 1A and 3A, each of the first and second webs 26, 28 has a center portion 34 and opposed side portions 36, 38. Each of the first and second webs 10 has a substantially similar width W larger than the transverse dimension D of the spring unit 10 so that the opposed side portions 36, 38 generally extend beyond the transverse dimension D of the spring unit 10 in substantially equal amounts. The lengths of the first and second webs 26, 28 are considerably longer than the longitudinal dimension L of a single spring unit 10 so that plural spring units 10 may be packaged by the inventive method described in further detail below.

In the present inventive method of packaging a spring unit 10, the first and second webs 26, 28 are carried upon respective first and second cores 40, 42 which allow the first and second webs 26, 28 to be drawn therefrom in reverse directions as indicated by directional arrows 40*a*, 42*a* (see FIG. 1). The first and second webs 26, 28 are drawn between respective first and second guide rollers 44, 46, the rollers 44, 46 being spaced apart from each other so that spring unit 10 may be received therebetween. A conveyor 48 transports the spring unit 10 in the direction of arrow 48*a* into a space 50 defined between the first and second rollers 44, 46. The first and second webs 26, 28 are then passed over and under and located against the first and second surfaces 12, 14, respectively, of the spring unit 10.

In a first preferred embodiment, after the first and second webs 26, 28 are located against the respective first and second surfaces 12, 14 of the spring unit 10, an adhesive unit 52 deposits adhesive 56 upon the reverse side 32 of the side portions 36, 38 of each of the first and second webs 26, 28. The spring unit 10 having the first and second webs 26, 28 located thereagainst is then passed to a folding unit 54 which folds the inner surface 32 of the side portions 36, 38 of each of the first and second webs 26, 28 with the adhesive 56 deposited thereon against the reverse side 32 of the respective center portion 34 and against the top and bottom turns 22, 24 of the outermost coil springs 20 comprising the longitudinal margins of the spring unit 10.

Figure 3:
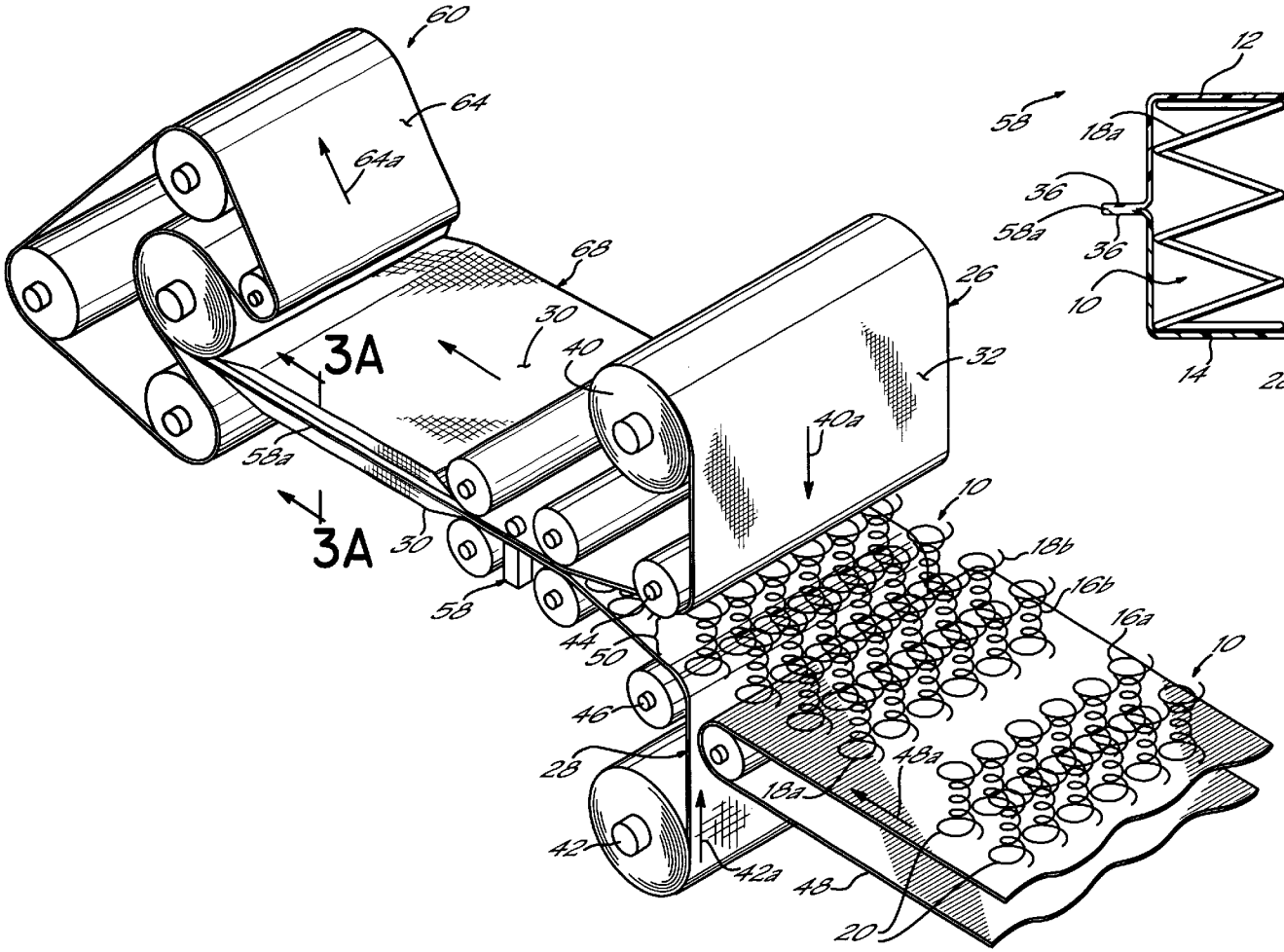
FIG. 3 is a perspective view of a second preferred embodiment of the present inventive method.

As seen in FIGS. 3 and 3A, in a second preferred embodiment, after the first and second webs 26, 28 are located against respective first and second surfaces 12, 14 of the spring unit 10, the spring unit 10 with the first and second webs 26, 28 located thereagainst is passed to a welding unit 58. The inner surface 32 of the side portion 36 of the first web 26 is welded to the inner surface 32 of the side portion 36 of the second web 28. While only side portions 36 of the first and second webs 26, 28 are shown in FIG. 3A, it will be understood that side portions 38 are a mirror image thereof and are welded in a similar manner. The welding together of the first and second webs 26, 28 may be accomplished by any suitable welding process for woven or non-woven materials known in the art, e.g., ultrasonic or radio frequency welding, to create a weld 58*a*, as seen in FIG. 3A.

Figure 2:
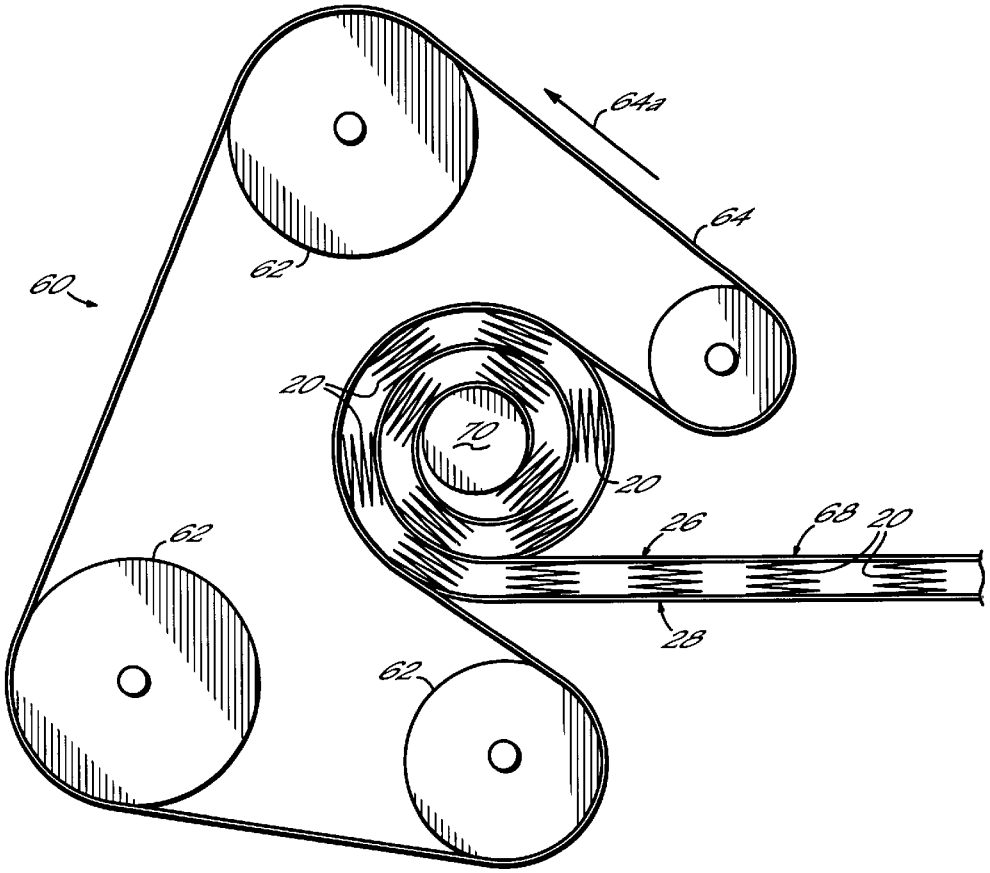
FIG. 2 is a side view of bedding products being roll packed.

After the first and second webs 26, 28 have been fixedly located against the first and second surfaces 12, 14 of the spring unit 10 by either the gluing or the welding methods as described above, the spring unit 10 with the first and second webs 26, 28 located thereagainst is then passed to a roll packing machine 60 as best seen in FIG. 2. The roll packing machine 60 has a plurality of rollers 62 which carry thereon an endless belt 64 traveling in a direction indicated by directional arrow 64*a*. The spring unit 10 with the first and second webs 26, 28 attached permanently thereto comprises a bedding or seating product 68 ready for shipment, for example, from a spring manufacturer to a mattress or seat manufacturer. As the product 68 is wound about a core 70 upon which it is to be transported, the roll packing machine 60 compresses the bedding or seating product 68 so that plural bedding or seating products 68 may be so packaged.

When the packaged roll of bedding or seating units 68 arrive at the mattress or seat manufacturer's facility, all that the manufacturer needs to do is unroll the packaged products from the roll and transverse cut the webs 26, 28 at a location between the spaced spring units 10. The resulting bedding or seating product 68 having the insulator material permanently secured to its top and bottom sides is than ready for application of the appropriate padding and upholstery materials to complete the mattress or seat.

Figure 4:
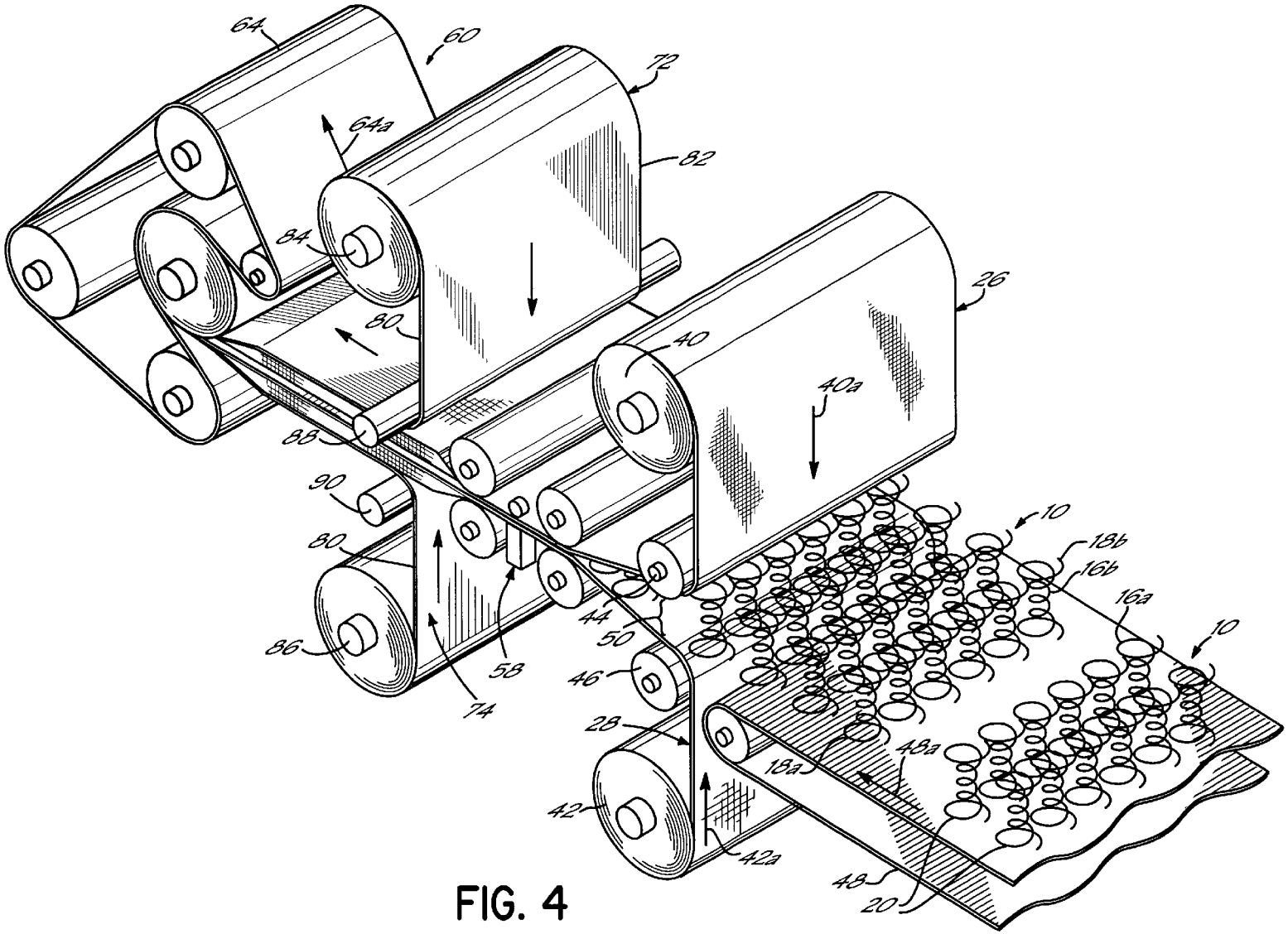
FIG. 4 is a perspective view of an alternative embodiment of the present inventive method of packaging resilient spring units.
Figure 5:
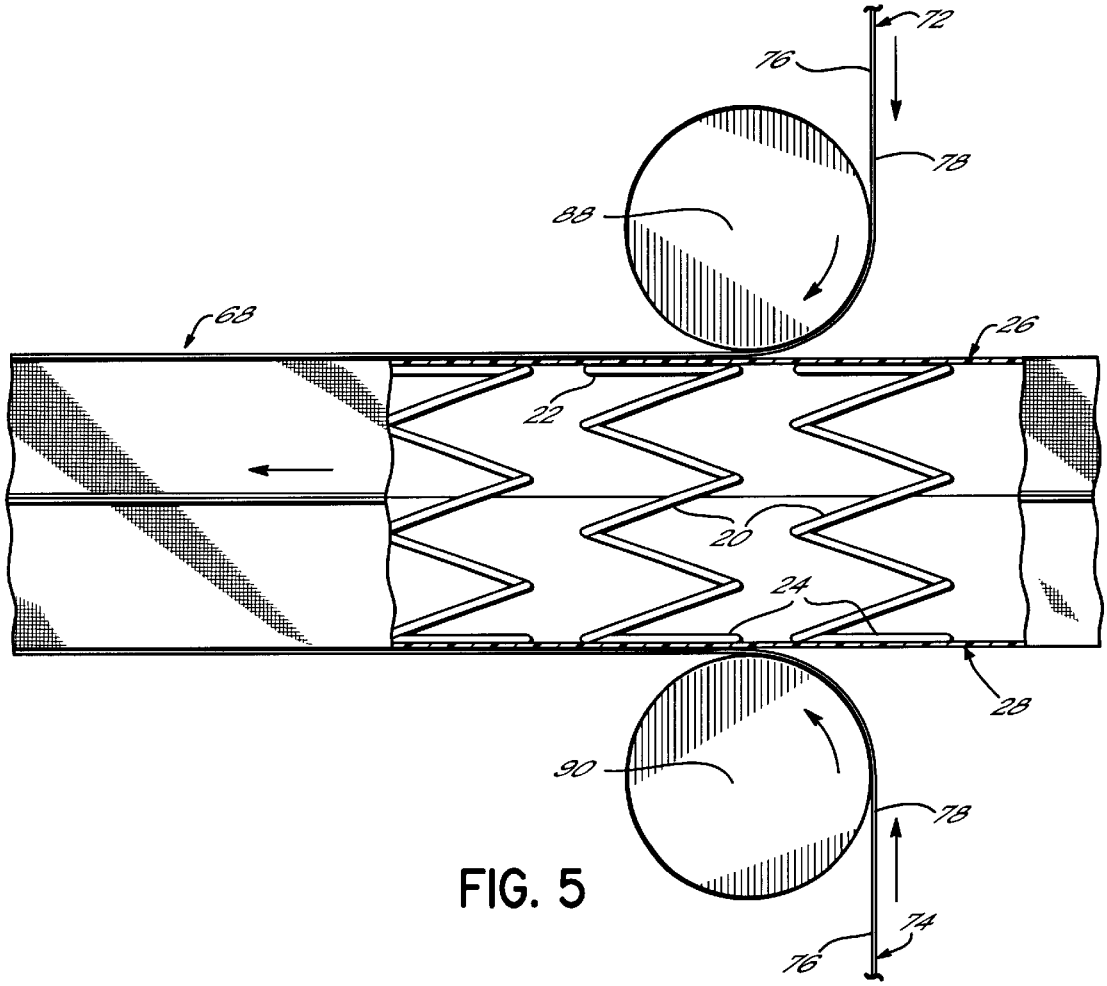
FIG. 5 is a view similar to FIG. 1A, showing a cross-section of a bedding product produced by the method illustrated in FIG. 4.
Figure 6:
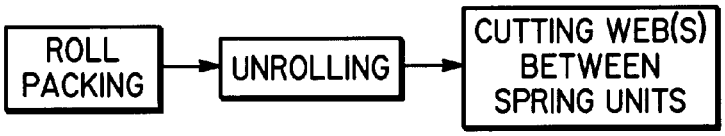
FIG. 6 is a flow chart of a portion of the method of the present invention.

Another preferred embodiment is seen in FIGS. 4 and 5 in which like numerals refer to like elements. After the webs of insulator material 26, 28 are applied to the first and second surfaces 12, 14 of the spring unit 10, additional roll-packing material such as paper or sheet plastic is used as separating material between layers of rolled bedding products. In particular, first and second sheets or webs of separating material 72, 74 are located against respective first and second webs of insulator material 26, 28. Each first and second web of separator material 72, 74 has outer and inner surfaces 76, 78, respectively, and opposed side edges 80, 82 defining a width. The width of the webs of separator material 72, 74 is similar to the transverse dimension D of the spring unit 10. The first and second webs of separator material 72, 74 are carried upon respective first and second cores 84, 86 which allow the first and second webs 72, 74 to be drawn therefrom. The first and second webs 72, 74 are drawn between respective first and second guide rollers 88, 90, the rollers 88, 90 being spaced apart from each other so that the spring unit 10 with the first and second webs of insulator material 26, 28 applied thereto may be received therebetween.

Thereafter, as the bedding products 68 are roll-packed, the first and second sheets of separating material 72, 74 further package the series of plural bedding products 68. When the roll-packed bedding products 68 are sent from the spring manufacturer to the mattress manufacturer, the mattress manufacturer would then unroll the series of bedding products 68, each being connected by the continuous webs of insulator material 26, 28, discard the additional webs of separator material 72, 74, and then simply sever the webs of insulator material 26, 28 connecting the series of bedding products 68 to form plural separate bedding products. Alternatively, the webs of insulator material 26, 28 may be severed between bedding products 68 before roll packing in this embodiment because of the inclusion of the webs of separating materials 26, 28 between the roll packed bedding products 68.

Thus, in both the first and second embodiments of the present inventive method, a series of plural packaged bedding products 68 is formed by the spring manufacturer which is thereafter shipped to the mattress manufacturer. The series of roll-pack bedding products 68 is unrolled by the mattress manufacturer and, if necessary as in the first method, severed into separate bedding products with the webs of insulator material 26, 28 still securely applied to each spring unit.

Figure 7:
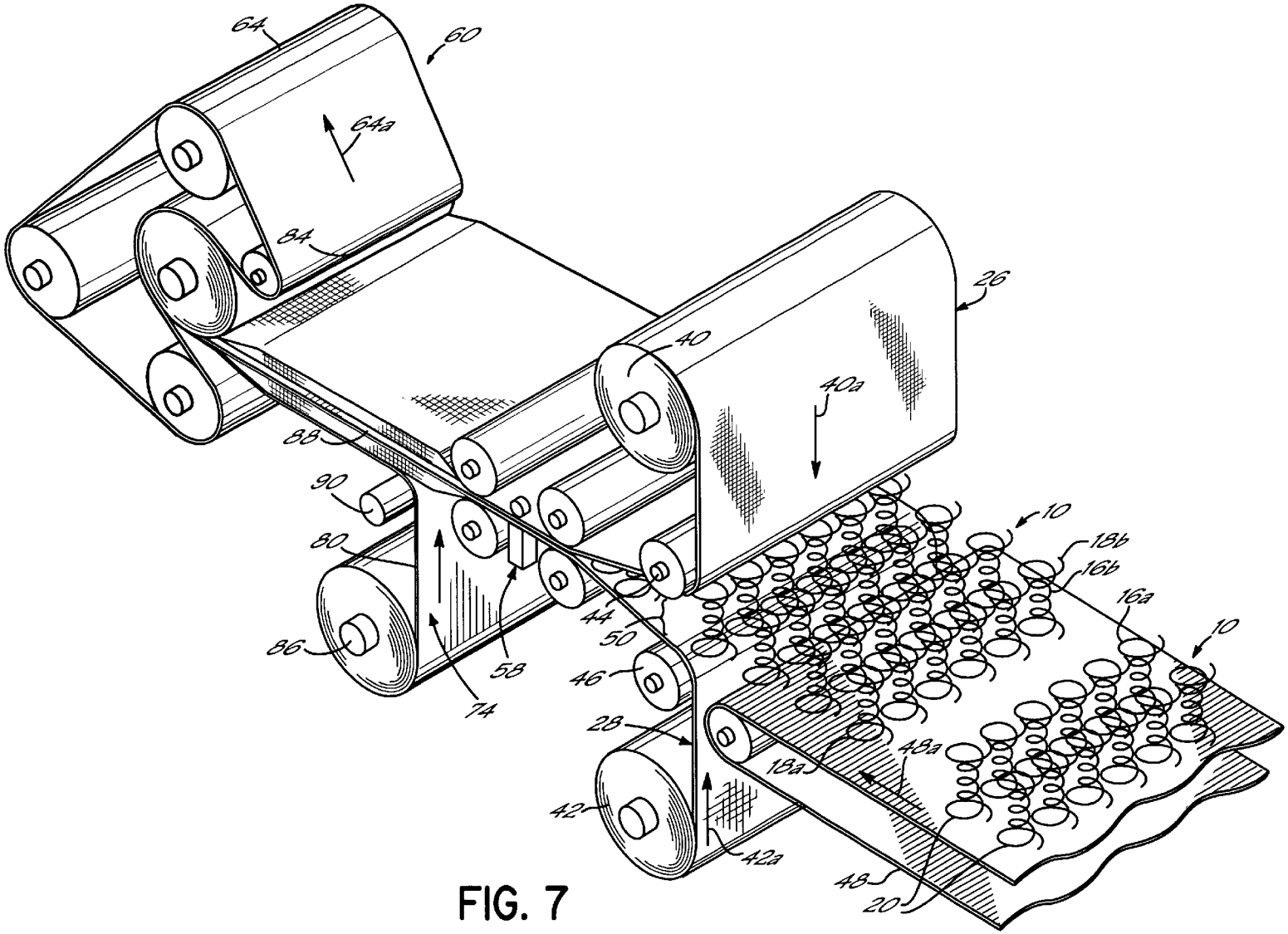
FIG. 7 is a perspective view similar to FIG. 3 but illustrating an alternative embodiment of the present invention.

With reference now to FIG. 7, there is illustrated another method of roll packing bedding products 68. This method is very similar to the method illustrated and described hereinabove with reference to FIGS. 4 and 5. Accordingly, in this embodiment, those components of the illustrated system which are identical to the components of FIGS. 4 and 5 have been given identical numerical designations.

The method and system illustrated in FIG. 7 is substantially identical to the method illustrated in FIGS. 4 and 5, but differs in that it omits the use of the second web 72 of separator material. In many applications, there is no need for a second web of separator material.

In the event that only a single web 74 of separator material is employed, as illustrated in FIG. 7, the end of the web 74 of separator material is first attached to the dowel or mandrel 70 by having at least one wrap of the separating material applied to the dowel or mandrel after which the bedding products 68,—having the web of insulator material already previously permanently attached thereto—are sequentially fed into the nip 73 between the dowel or mandrel 70 and the web 74 of separating materials. The web of separating material then functions to maintain the roll packed bedding products 68 in a compressed state and separated one from the other as they are rolled up through multiple plies or layers onto the dowel or mandrel 70.

After an appropriate number of bedding products 68 have been roll packed onto the dowel or mandrel 70, the single web 74 of separating material is then cut and wound about the exterior of the roll of roll packed bedding products 68 and taped or glued or otherwise secured to the exterior of the pack to complete the roll pack. This roll pack is then shipped to the mattress manufacturer where the roll pack is unrolled by the manufacturer and the web or webs 26, 28 of insulator material are transversely severed between separator bedding products if the web or webs of insulator material had not been severed prior to insertion of the bedding products into the roll packing machine. That mattress manufacturer then uses the bedding product 68 having the insulator material already permanently attached to the spring units to manufacture a mattress by simply applying conventional padding and upholstery to the bedding product. This saves the mattress manufacturer from having to inventory, cut to size and apply the insulator material to the spring unit with a resulting substantial reduction in manual labor.

Figure 8:
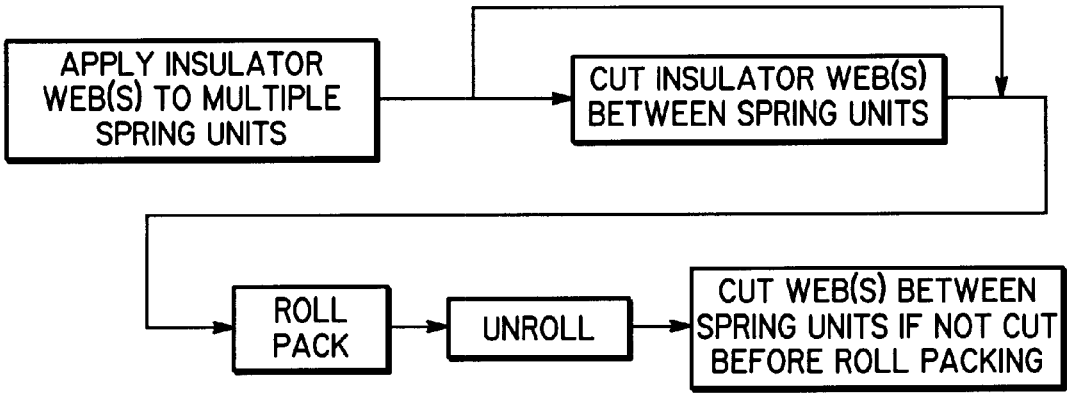
FIG. 8 is a flow chart of the method of roll packing illustrated in FIG. 7.

With reference to FIG. 8, there is illustrated the method practiced by the apparatus disclosed in FIGS. 4 and 7. As is there evident, after the application of the insulator webs to the multiple spring units as depicted in FIGS. 1–5 and 7, the bedding products having the insulator material permanently applied thereto, are supplied to the roll packing machine where they are roll packed. The web or webs of insulator material applied to the spring units may be cut between the spring units before the bedding products are roll packed or the web or webs may be cut between the bedding products after unrolling of the roll packed products.

From the above disclosure of the detailed description of the present invention and the preceding summary of the preferred embodiment, those skilled in the art will comprehend the various modifications to which the present invention is susceptible. Therefore, I desire to be limited only by the scope of the following claims and equivalents thereof.

We claim:

1. A method of packaging a plurality of spring units, each spring unit comprising a plurality of coil springs, each of said coil springs having a top turn and a bottom turn, said top turns of said coil springs defining a generally planar first surface and said bottom turns of said coil springs defining a generally planar second surface, said method comprising the steps of:

providing first and second webs of insulator material, each of said webs of insulator material being adapted to separate said spring units from padding to be applied to said spring units, each of said webs of insulator material having a width including a pair of opposing side portions and a center portion;

locating said first and second webs of insulator material against said first and second surfaces, respectively, of said spring units;

permanently securing said first and second webs of insulator material to said spring units;

locating at least one web of separator material against one of said webs of insulator material; and roll-packing said spring units and said webs of insulator material such that said spring units are at least partially compressed and upon unrolling, said webs of insulator material remain permanently connected to said spring units.

2. The method of claim 1 wherein said step of permanently securing said first and second webs of insulator material to said spring units comprises folding said side portions of said first and second webs of insulator material around said top and bottom turns of outermost coil springs of said spring units and securing said side portions to said central portions of said webs of insulator material.

3. The method of claim 2 wherein said step of securing said side portions to said center portions of said webs of insulator material comprises bonding said side portions to said respective center portions of said webs of insulator material.

4. The method of claim 1 further comprising the steps of:

providing first and second web rolls carrying said first and second webs of insulator material, respectively; and passing said first and second webs of insulator material between respective first and second rollers before locating said first and second webs of insulator material against said first and second surfaces, respectively, of said spring units.

5. The method of claim 1 further comprising the step of unrolling said spring units, said spring units remaining connected to said webs of insulator material.

6. The method of claim 5 further comprising the step of cutting said webs of insulator material between adjacent spring units.

7. A method of packaging a plurality of spring units, each of said spring units having a generally planar first surface, a generally planar second surface, a longitudinal dimension and a transverse dimension, said method comprising the steps of:

providing first and second web rolls of insulator material, each of said webs of insulator material having inner and outer surfaces and opposed side edges defining a width of said web, each of said webs of insulator material being adapted to separate said spring units from padding to be applied to said spring units and having opposed side portions and a central portion between said side portions across said width of said web;

passing said first and second webs of insulator material past said first and second surfaces of said spring units;

locating said first and second webs of insulator material against said first and second surfaces, respectively, of said spring units;

permanently securing said side portions of said first web of insulator material to said side portions of said second web of insulator material such that said spring units are sandwiched between said webs of insulator material;

locating at least one web of separator material against one of said webs of insulator material; and roll-packing said spring units and said first and second webs of insulator material such that said spring units are at least partially compressed and upon rolling said spring units, said webs of insulator material remain permanently secured to each other.

8. The method of claim 7 further comprising the step of unrolling said spring units.

9. The method of claim 8 further comprising the step of cutting said webs of insulator material between adjacent spring units.

10. The method of claim 7 wherein said step of securing said side portions of said first web of insulator material to said side portions of said second web of insulator material comprises bonding said side portions of said webs of insulator material to each other.

11. The method of claim 7 wherein said step of securing said side portions of said first web of insulator material to said side portions of said second web of insulator material comprises welding said inner surface of said side portions of said first web of insulator material to said inner surface of said side portions of said second web of insulator material.

12. The method of claim 7 further comprising the step of passing said first and second webs of insulator material between parallel rollers before passing said webs of insulator material past said first and second surfaces of said spring units.

13. The method of claim 12 wherein said parallel rollers rotate in opposite directions.

14. The method of claim 7 wherein said web rolls rotate in opposite directions.

15. A method of packaging a plurality of spring units, each of said spring units comprising a plurality of coil springs, each of said coil springs having a top turn and a bottom turn, each of said spring units having a generally planar first surface defined by said top turns and a generally planar second surface defined by said bottom turns, a longitudinal dimension and a transverse dimension, said method comprising the steps of:

providing first and second web rolls of insulator material, each of said web rolls comprising a web of insulator material carried upon a core and each of said webs of insulator material having inner and outer surfaces and opposed side edges defining a width of said web, said web of insulator material being wider than said transverse dimensions of said spring units, each of said webs of insulator material being adapted to separate said spring units from padding to be applied to said spring units and having opposed side portions and a central portion between said side portions;

passing said first and second webs of insulator material over said first and second surfaces of said spring units, respectively, said spring units being oriented such that said transverse dimensions of said spring units are generally perpendicular to said opposed side edges of said webs of insulator material;

locating said first and second webs of insulator material against said first and second surfaces, respectively, of said spring units;

folding said side portions of said first and second webs of insulator material around said top and bottom turns, respectively, of said coil springs along said longitudinal dimensions of said spring units so that each of said side portions of said first and second webs of insulator material is folded back upon said respective center portion of each of said first and second webs of insulator material;

permanently securing said side portions of said first and second webs of insulator material to said central portions of said first and second webs of insulator material;

locating at least one web of separator material against one of said webs of insulator material; and roll-packing said spring units with said first and second webs of insulator material secured to said spring units such that said spring units are at least partially compressed and upon unrolling said spring units said webs of insulator material remain permanently secured to said spring units.

16. The method of claim 15 further comprising the step of unrolling said spring units.

17. The method of claim 16 further comprising the step of cutting said webs of insulator material between adjacent spring units.

18. A method of packaging plural spring units, each of said spring units having a generally planar first surface, a generally planar second surface, a longitudinal dimension defined between opposed end surfaces, and a transverse dimension defined between side surfaces, said method comprising the steps of:

providing first and second web rolls of insulator material, each of said web rolls comprising a web of insulator material carried upon a core, each of said webs of insulator material being adapted to separate said spring units from padding to be applied to said spring units, each of said webs of insulator material also having inner and outer surfaces and opposed side edges defining a width of said web, said width being larger than said transverse dimensions of said spring units, each of said webs of insulator material having opposed side portions and a central portion between said side portions;

passing said first and second webs of insulator material past said first and second surfaces of said spring units, respectively, said spring units being oriented such that said end surfaces of said spring units are generally perpendicular to said opposed side edges of said webs of insulator material;

locating said first and second webs of insulator material against said first and second surfaces, respectively, of said spring units;

locating said inner surface of said side portions of said first web of insulator material against said inner surface of said side portions of said second web of insulator material;

permanently securing said side portions of said webs of insulator material together, whereby said spring units with said first and second webs of insulator material secured thereto constitute bedding products;

locating at least one web of separator material against one of said webs of insulator material; and roll-packing said bedding products whereby said spring units are at least partially compressed and upon unrolling said bedding products said webs of insulator material remain permanently secured to each other.

19. A method of packaging a plurality of spring units, each spring unit comprising a plurality of coil springs, each of said coil springs having a top turn and a bottom turn, said top turns of said coil springs defining a generally planar top surface and said bottom turns of said coil springs defining a generally planar bottom surface, said method comprising the steps of:

providing first and second webs of insulator material, each of said webs of insulator material having a generally uniform width including a pair of opposing side portions and a center portion, and inner and outer surfaces, each of said webs of insulator material being adapted to separate said spring units from padding to be applied to said spring units;

locating said first and second webs of insulator material against said top and bottom surfaces, respectively, of said spring units such that said inner surfaces of said webs of insulator material abut said spring units;

folding said side portions of said webs of insulator material around said top and bottom turns of select coil springs of said spring units;

permanently securing said side portions fo said webs of insulator material to said central portions of said webs of insulator material to secure said webs of insulator material to said spring units;

locating at least one web of separator material against one of said webs of insulator material; and roll-packing said spring units such that said spring units are at least partially compressed, said spring units being connected to each other by said webs of insulator material.

20. The method of claim 19 further comprising the steps of:

providing first and second web rolls carrying said first and second webs of insulator material, respectively; and passing said first and second webs of insulator material between respective first and second rollers before locating said first and second webs against said first and second surfaces, respectively, of said spring units.

21. A method of packaging a plurality of spring units, each spring unit comprising a plurality of coil springs, each of said coil springs having a top turn and a bottom turn, said top turns of said coil springs defining a generally planar top surface and said bottom turns of said coil springs defining a generally planar bottom surface, said method comprising the steps of:

providing a web of insulator material, said web of insulator material being adapted to separate said spring units from padding to be applied to said spring units and having a pair of side portions, a center portion between said side portions, and inner and outer surfaces;

covering one of the top and bottom surfaces of the spring units with said web of insulator material;

depositing adhesive upon the inner surfaces of the side portions of said web of insulator material;

folding said side portions of said web of insulator material around said top and bottom turns of select coil springs of said spring units, allowing said adhesive to set, thereby permanently securing said side portions of said web of insulator material to said central portion of said web of insulator material and secure said web of insulator material to said spring units, locating a web of separator material against said web of insulator material; and roll-packing said spring units connected to each other by said web of insulator material such that said spring units are at least partially compressed and upon unrolling said web of insulator material remains connected to said spring units.

22. The method of claim 21 wherein said spring units are oriented such that opposed side surfaces of said spring units are parallel opposed side edges of said web of insulator material.

23. A method of packaging a plurality of spring units, each spring unit comprising a plurality of coil springs, each of said coil springs having a top turn and a bottom turn, said top turns of said coil springs defining a generally planar top surface and said bottom turns of said coil springs defining a generally planar bottom surface, said method comprising the steps of:

moving said spring units into a space between a pair of guide rollers;

providing first and second webs of insulator material adapted to separate said spring units from padding to be applied to said spring units, each of said webs of insulator material having a pair of side portions, a center portion between said side portions, and inner and outer surfaces;

passing said webs of insulator material between said guide rollers;

covering the top and bottom surfaces of the spring units with said webs of insulator material;

permanently securing said side portions of each of said webs of insulator material to said central portion of said web of insulator material to secure said web of insulator material to said spring units;

locating at least one web of separator material against said one of said webs of insulator material; and roll-packing said spring units and said webs of insulator material such that said spring units are at least partially compressed, said spring units being connected to each other by said webs of insulator material such that upon unrolling said spring units, said webs of insulator material remain connected to said spring units.

24. A method of packaging a plurality of spring units, each spring unit comprising a plurality of coil springs, each of said coil springs having a top turn and a bottom turn, said top turns of said coil springs defining a generally planar top surface and said bottom turns of said coil springs defining a generally planar bottom surface, said method comprising the steps of:

providing a web of insulator material adapted to separate said spring units from padding to be applied to said spring units, said web of insulator material having a generally uniform width including a pair of opposing side portions and a center portion;

locating said web of insulator material against one of said top and bottom surfaces of said spring units;

folding said side portions of said web of insulator material around end turns of select coil springs of said spring units;

permanently securing said side portions of said web of insulator material to said central portion of said web of insulator material to secure said web of insulator material to said spring units;

locating at least one web of separator material against said web of insulator material; and roll-packing said spring units and said web of insulator material such that said spring units are at least partially compressed, said spring units being connected to each other by said web of insulator material such that upon unrolling said spring units, said web of insulator material remains connected to said spring units.

* * * * *